United States Patent [19]

Janetzke et al.

[11] Patent Number: 4,582,031

[45] Date of Patent: Apr. 15, 1986

[54] ELECTRONIC CONTROL SYSTEM FOR AN INTERNAL COMBUSTION ENGINE

[75] Inventors: Helmut Janetzke; Helmut Kauff; Alfred Schulz, all of Schwieberdingen, Fed. Rep. of Germany

[73] Assignee: Robert Bosch GmbH, Stuttgart, Fed. Rep. of Germany

[21] Appl. No.: 542,069

[22] Filed: Oct. 14, 1983

[30] Foreign Application Priority Data

Oct. 15, 1982 [DE] Fed. Rep. of Germany ..... 3238190

[51] Int. Cl.[4] ..... F02M 3/07

[52] U.S. Cl. ..... 123/339; 123/478

[58] Field of Search ..... 123/478, 486, 487, 494, 123/339, 585, 480

[56] References Cited

U.S. PATENT DOCUMENTS

| | | | |
|---|---|---|---|
| 4,015,563 | 4/1977 | Drews et al. | 123/485 |
| 4,176,629 | 12/1979 | Kawai et al. | 123/486 X |
| 4,277,829 | 7/1981 | Tokuda et al. | 123/480 X |
| 4,425,886 | 1/1984 | Kuroiwa et al. | 123/585 X |
| 4,481,929 | 11/1984 | Hasegawa | 123/440 X |

*Primary Examiner*—Tony M. Argenbright

*Attorney, Agent, or Firm*—Michael J. Striker

[57] ABSTRACT

Disclosed is an electronic system for computing control magnitudes for a control system of an internal combustion engine. The control magnitudes are derived by computation from measured auxiliary parameters. The control magnitude such as suction pipe pressure is computed from its relationship with the flow rate of air mass, or throttle valve position and rotary speed. Atmospheric pressure is computed from the air mass flow, rotary speed and throttle valve position or from the cross-section of the channel by-passing the throttle valve and from the supplied air mass. The computation arrangement can be either analog or digital.

8 Claims, 8 Drawing Figures

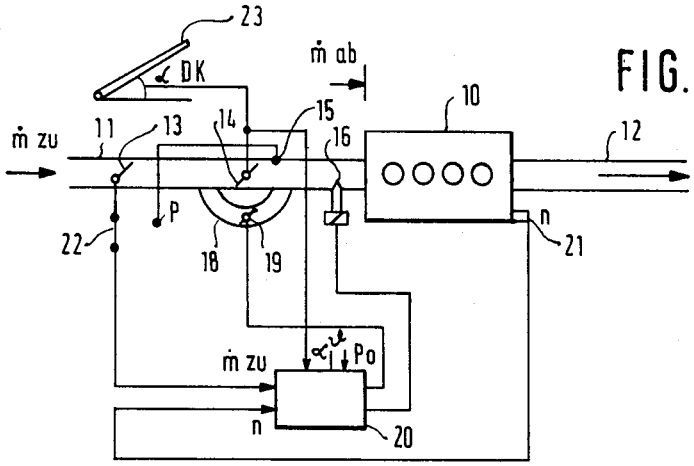
FIG.1
FIG.3
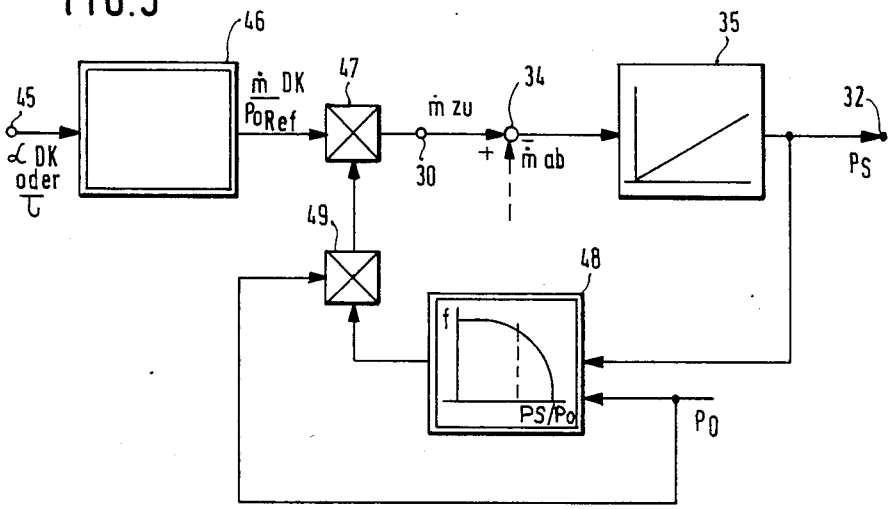

ELECTRONIC CONTROL SYSTEM FOR AN INTERNAL COMBUSTION ENGINE

BACKGROUND OF THE INVENTION

The present invention relates in general to an electronic system for controlling or regulating the main operational parameters of an internal combustion engine, preferably non-load rotary speed or the amount of fuel to be metered, on dependency of auxiliary parameters such as rotary speed, weight rate of airflow in suction pipe, position of throttle valve, pressure in suction pipe, atmospheric pressure or temperature.

Regulating systems of this kind are designed to meet a variety of requirements such as, for example, driving behavior of a motor vehicle equipped with the internal combustion engine, composition of exhaust gas, and a minimum fuel consumption. In regulating stoichiometric values of sucked-in fuel mixture and of values close to the latter in an internal combusion engine having an externally applied ignition, it is necessary to determine the weight rate of air flow in the suction pipe. For this purpose there are known measuring systems using flip valve meters for the amount of air or air mass meters using heating wire. According to the measured weight rate of air flow a corresponding raising signal for fuel is generated.

In order to achieve in the case of a no-load operation the smallest possible consumption of fuel, no-load rotary speed regulators have been applied which take care of maintaining a minimum no-load rotary speed which remains constant even when sudden load changes occur. An example of the no-load rotary speed regulator of this type is described in German publication No. 3,039,435. Due to the fact that rotary speed fluctuations in the last instance are reactions of I.C engine to outer influences and hence the rotary speed signals represent the last stage in the regulating chain, it takes of necessity a certain time period from the start of an action on the I.C. engine to the occurrence of a reaction. In an I.C. engine running at extremely low rotations during no-load conditions the danger is present that the cycles turn around regularly in the case when the regulating system operates at a low rotary speed limit.

In order to avoid this uncertainity factor other known no-load regulating systems attempt to determine parameters which react faster to external influences and evaluate these parameters for regulating purposes.

Publication WO-Al No. 81/01 591 teaches how to apply suction pressure of an I.C. engine for its no-load speed regulation. This known device, however, utilizes the suction pressure only and therefore it cannot guarantee an exact adherence to the no-load or idling rotary speed.

SUMMARY OF THE INVENTION

A general object of the present invention is to overcome the aforementioned disadvantages.

In particular, it is an object of this invention to provide regulating system of the aforementioned type which enables fast and reliable regulation of idling speed without the need of additional expenditures on conventional electronic systems for controlling or regulating the operational parameters of an internal combustion engine.

In keeping with these objects and others which will become apparent hereafter, one feature of the invention resides, in an electronic control system for an I.C. engine, in the provision of means for deriving control parameters for the regulation of the main operational parameters (idling rotary speed or fuel dosing) from the auxiliary parameters. Especially for the idling speed regulation, the processing of a pressure signal has proved as particularly advantageous.

In comparison with prior art systems, this invention has the advantage that additional sensors can be dispensed with inasmuch as the desired control signals can be determined by computation from auxiliary parameters. For instance, the sucked-in air mass can be exactly determined from mathematic relationships to the pressure conditions in suction pipes, and also in another case when the sucked-in air mass is already available as a signal, it can be used for regulating pressure in suction pipes which is of particular importance for the idling speed control. For this mathematic determination of the control parameters, digital computing devices are advantageous. In the following description however also analog computing techniques will be shown which lead to simplification of the regulating construction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 shows a schematic illustration of an electronic system for controlling or regulating fuel injection of an I.C. engine having external ignition;

FIG. 3 is a block circuit diagram of a modified system of FIG. 2 for processing the throttle valve position instead of an air mass signal;

DESCRIPTION OF THE PREFERRED EMBODIMENTS

Figure 2A:
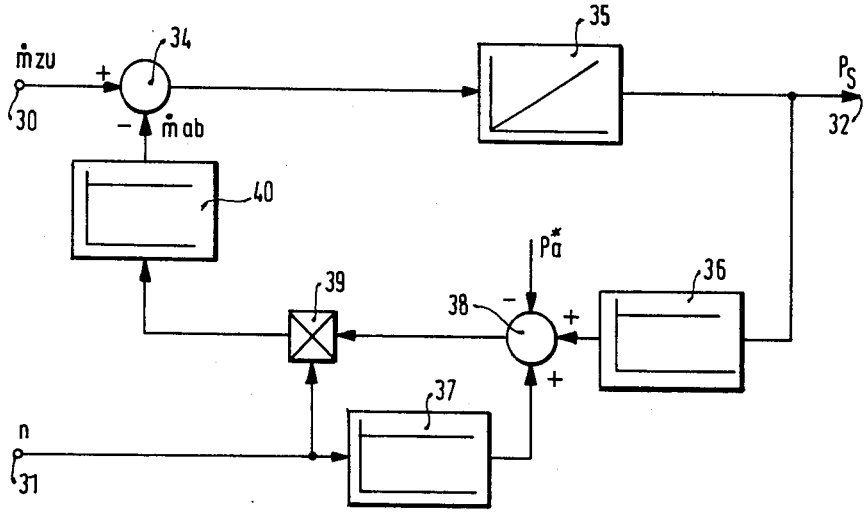
FIGS. 2*a* and 2*b* show respectively box circuit diagrams for determining pressure in the suction pipe from rotary speeds and supplied air mass (related to a stroke) parameters.

FIG. 1 illustrates in a system diagram an internal combustion engine having external ignition, and the variation of its essential components in the fuel mixture production. Reference numeral 10 indicates the internal combustion engine having a suction pipe 11 and an exhaust gas pipe 12. In the suction pipe 11, there are arranged in successive order an air sensor 13, a throttle valve 14, a pressure sensor 15 and a fuel dosing element 16. Reference numberal 18 indicates a by-pass channel around the throttle valve 14. A cross-section controlling member 19 in the by-pass channel is an externally adjustable flap. Control signals for the fuel dosing element 16 as well as for adjusting the control member 19 in the by-pass channel are generated in an electronic control apparatus 20. These control signals are computed from input magnitudes such as rotary speed, weight rate of air flow in suction pipe, opening signal for the throttle valve as well as ambient temperature and pressure. A rotary speed sensor 21 is coupled to engine 10 to generate a rotary speed signal. Signal $\dot{m}$ corresponding to the weight rate of air flow is produced either at the air through flow sensor 13 or at the pressure sensor 15, depending on the position of switch 22. The position of the throttle valve 14 is controlled in conventional manner by a gas pedal 23. The electronic control apparatus has an input for receiving the position signal from the throttle valve, which is applicable at least in three stages, namely an idling or no load signal, partial load signal and full load signal.

The fuel mixture producing system whose construction is schematically illustrated in FIG. 1, is well known in the art. In its operation it is essential that engine 10 in any of its operational conditions receive an optimum fuel mixture corresponding to that condition that means depending on the operational range, different lambda-values are to be determined and exactly maintained. A lambda-value denotes the ratio of an air mass to a fuel mass. Known devices for determining an air mass to be supplied to an I.C. engine are for example flap-type air volume sensors or heating wire type air mass sensors. As a rule, the performance of these known devices is satisfactory, nevertheless at the lower range of the air flow problems are encountered due to the fact that at the latter range this measurement is no longer accurate because of the leakage air streaming around the sensor flap for the air volume, and the like. In this lower air through-flow range, however, pressure measure in the suction pipe has proved more exact and reliable. Pressure measurements of this kind are also well known in the art since long time. For example, Applicants have already designed a so-called D-jectronic system in which depending on a pressure signal in the suction pipe a corresponding amount of fuel to be injected has been determined. The disadvantages of a pure pressure signal processing, however, are also well known. These disadvantages result primarily from pulsations in the air intake pipe occurring at higher loads.

For an I.C. engine the following physical relations are valid between suction pipe pressure ps, the supplied air mass $\dot{m}$zu and the discharged air mass $\dot{m}$ab. The corresponding signal inlets are designated by reference character p, $\dot{m}$zu and $\dot{m}$ab in FIG. 1.

Suction pipe pressure ps $$ps = \frac{R(273^\circ + \theta_{LS})}{V_s} \int (\dot{m}zu\,(t) - \dot{m}ab\,(t))\,dt \tag{1}$$

supplied air mass $\dot{m}$zu $$\dot{m}zu(t) = f(\alpha_{DK}) \cdot po \cdot c \cdot \sqrt{\left(\frac{ps}{po}\right)^{2/X} - \left(\frac{ps}{po}\right)^{\frac{X+1}{X}}} \tag{2}$$

discharged air mass $\dot{m}$ab $$\dot{m}ab(t) = \tag{3}$$

$$\frac{VH \cdot n \cdot \lambda_L}{2R(273^\circ + \theta_{LS})} \cdot \frac{X(\epsilon - 1) + 1}{X(\epsilon - 1)} \cdot \left(ps \cdot \frac{pa}{X(\epsilon - 1) + 1}\right)$$

definition of parameters:

C: constant
R: gas constant
$\theta_{LS}$: temperature of sucked in air
$V_s$: volume of suction pipe
$\dot{m}$zu: supplied air mass
$\dot{m}$ab: discharge flow mass
x: adibatic exponent
po: atmospheric pressure
pa: counter pressure of exhaust gas
VH: stroke volume of the engine
$\epsilon$: compression ratio of the engine
$\lambda_L$: volumetric efficiency
$\alpha_{DK}$: angle of opening of the throttle valve
n: rotary speed of the engine.

The above formulas make apparent the possibility to compute from the results of pressure measurement the air mass supplied to the engine. Alternatively, by measuring the supplied air mass, for example by means of a heating wire type air mass sensor, a pressure value can be determined which subsequently can be with advantage used for regulating the idling speed of the engine. In addition, the above formulas will elucidate that also atmospheric pressure can be determined from the individual magnitudes. In the final effect, by measuring several selected magnitudes it is possible to determine by computation other magnitudes without using special sensors for the latter and consequently it is possible to produce an improved electronic control system for I.C. engines at a relatively low cost.

Figure 5:
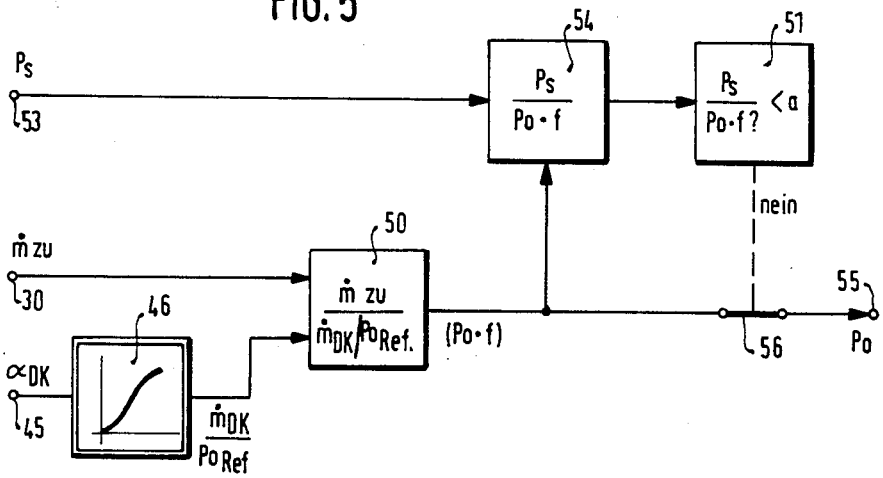
FIG. 5 is a flow chart for computing atmospheric pressure as a function of suction pipe pressure, the supplied air mass and the throttle valve position.
Figure 6:
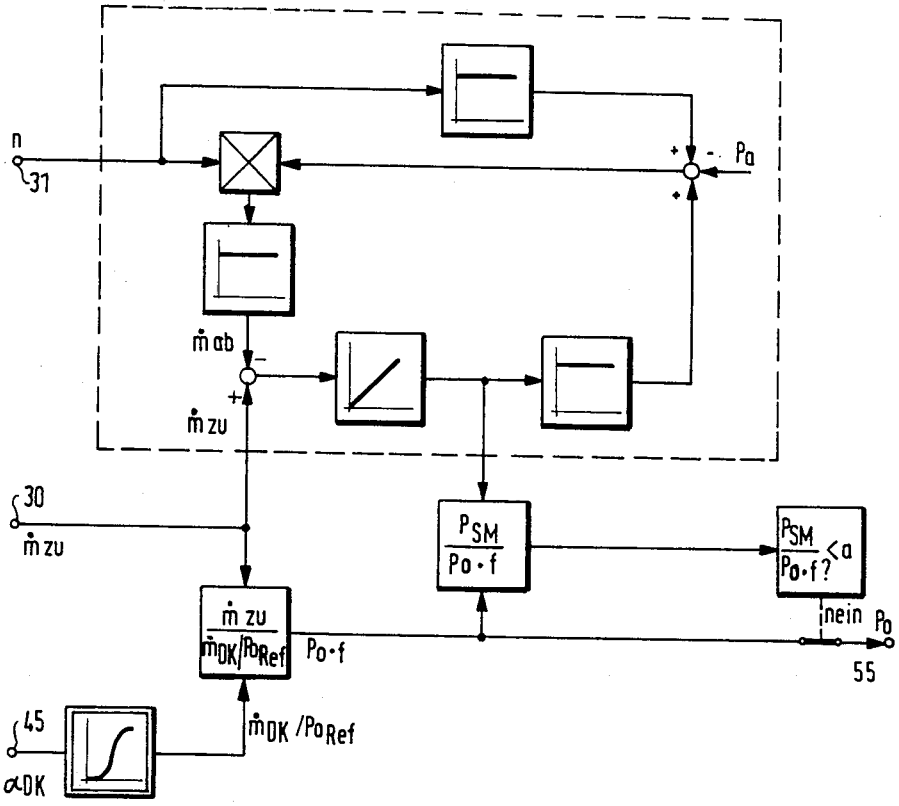
FIG. 6 is a block circuit diagram of combined systems of FIGS. 3 and 5.
Figure 7:
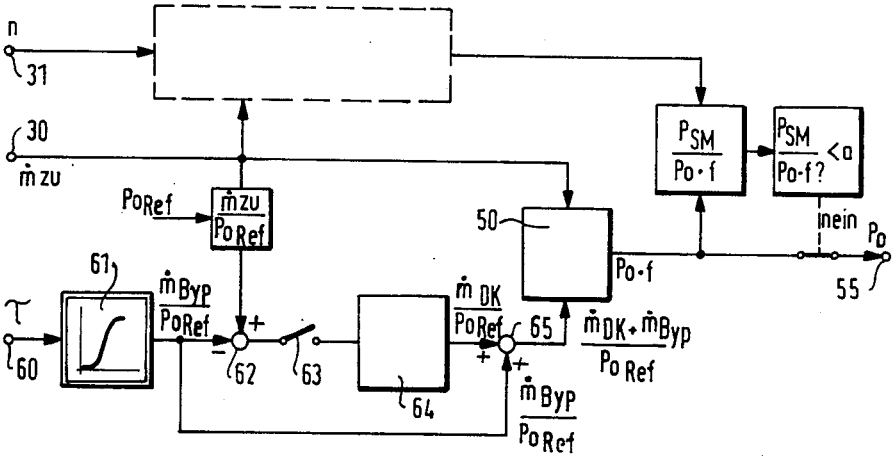
FIG. 7 is a modification of the system of FIG. 6.

The computation of suction pipe pressure from other input magnitudes are explained by way of examples in FIGS. *2a, 2b* and 3, whereas FIGS. 5 through 7 illustrate how to compute atmospheric pressure from selected magnitudes.

All the aforementioned FIGS. *2a, 2b* and 3 or 5 through 7 show in flow chart computation stages or steps which are required for the technical realization of the aforementioned mathematic formulas.

In the example of FIG. *2a* an air mass signal mzu is applied to an input terminal 30, the rotary speed signal is applied to input terminal 31 and a pressure signal is withdrawn from output terminal 32. The individual blocks denote symbolically the other computation stages of the aforementioned mathematical formulas 1 and 3 which for the sake of simplicity is made by an analog computing arrangement. The latter arrangement includes a differential (subtractor) stage 34 having its plus inlet connected to the input 30 for the flow mzu signal and its output is connected to an integrator 35. This series connection corresponds substantially to the mathematic formula 1.

Figure 2B:
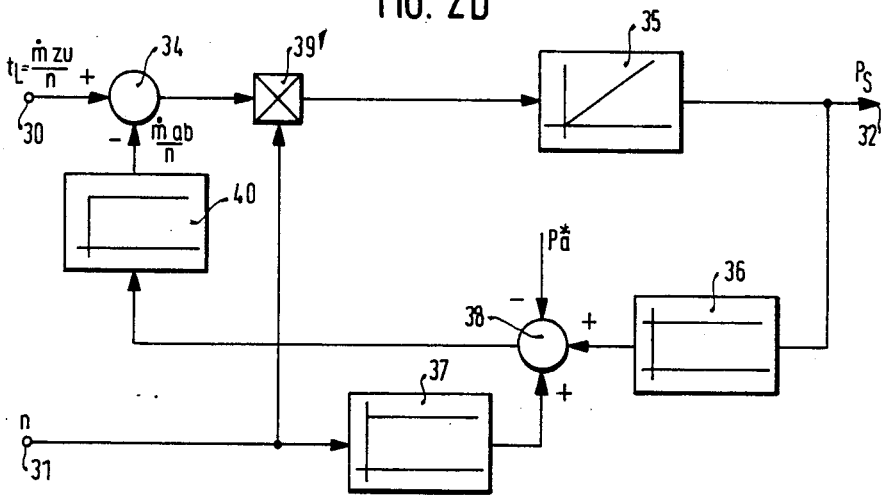

Air mass mab discharged from the suction pipe in accordance with formula 3 is represented substantially by referring magnitudes: rotary speed, suction pipe pressure and exhaust gas counter pressure. The suction pipe pressure signal $P_s$ is applied to proportionality member 36 and the rotary speed signal n is applied to proportionality member 37. The outputs of these members as well as the signal pa* which is proportional to the exhaust gas counterpressure, are applied to summer 38 whose output is connected to a multiplier 39. The other input of the multiplier is fed with the rotary speed signal n. The output signal $\dot{m}$ab from the multiplier is fed through another proportionality member 40 to the minus input of the differentiator 34. In dimensioning the individual computation stages the magnitudes contained in the two formulas 1 and 3 are to be considered. Also, the individual empirically determined correction magnitudes which are valid for individual models of IC engines under consideration can be also applied to these stages. As mentioned before, the signal $\dot{m}zu$ represents an air mass signal. According to a particular application it may be more advantageous to process the air mass related to a piston stroke rather than to process the air mass by itself. This application corresponds for example to the uncorrected fuel injection time $t_L$ in the L-jetronic injection device manufactured by the assignee of this application. When using this air mass in relation to the stroke care must be taken that a flow $\dot{m}ab$ signal related to the stroke is applied to the input of the differentiating stage 34. When this stroke related signal is obtained by connecting the multiplication stage 39 of FIG. 2*a* in the manner as illustrated in FIG. 2*b*. In the latter embodiment the output of the summer 38 is connected directly, to the proportionality member 40 and the multiplicator 39' is connected between the differentiating stage 34 and the integrator 35.

According to the formula 2 the amount of the supplied or incoming air mass is a function of the throttle valve position, of atmospheric pressure as well as of the quotient of the suction pipe pressure to the atmospheric pressure. Accordingly, there is again the possibility to determine by computation the air mass provided that the individual pressure values and the characteristics of the throttling flap are known. A schematic flow chart including blocks of an analog computing arrangement for determining a suction pressure value in dependence on the position of throttling valve is illustrated in FIG. 3. An input terminal 45 for a position signal of a throttle valve is connected to a characteristic line generator 46 for correlating the opening angle of the throttle valve to the flow of the air mass or to the amount of air at an atmospheric pressure $po_s$. The output of the characteristics generator 46 is connected to a multiplying stage 47 whose output is connected to the input terminal 30 of the embodiment of FIG. 2*a*. Inasmuch as the mathematic formula 2 referring the processing of an atmospheric pressure signal as well as of a quotient of a suction pipe pressure and an atmospheric pressure, block 48 designates a corresponding processing stage for the pressure signal. The output signal from the stage 48 is fed to a multiplicator 49 whose other input receives a signal po and whose output is supplied to the aforementioned multiplicator 47.

The formula 2 includes an expression with a square root $$\sqrt{\left(\frac{ps}{po}\right)^{\frac{2}{X}} - \left(\frac{ps}{po}\right)^{\frac{X+1}{X}}}$$

when designating the square root expression as b, then the value f equals c·b can be interpreted as a characteristic line over ps/po.

Figure 4:
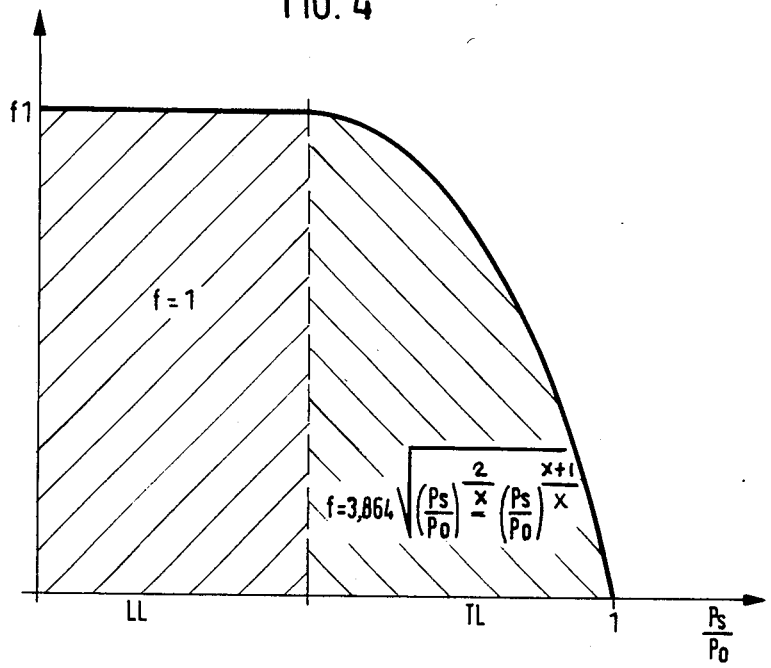
FIG. 4 is a block diagram of relation between pressure in suction pipe versus atmospheric pressure, shown with a corresponding mathematic formula.

A specific example of this plot is illustrated in FIG. 4. It will be recognized from this figure that up to a value of ps/po=0, 52,828, f has the value of 1 and above this value f declines in the form of parabola. In this graph the lower value of ps/po corresponds to the idling or no-load speed whereas values which are greater or equal to 1 correspond to the upper partial load or to the full load.

In the preferred embodiment of this invention a pressure signal for regulating idling speed is to be computed from the aforementioned mathematic formula 1. Since in the case of an idling speed according to FIG. 4, f=1, a considerable simplification of the course of computation according to FIG. 3 will result, inasmuch as the processing stage 48 for the pressure signal will process only an atmospheric pressure signal in accordance with formula 2. In other words, in the case of computation of suction pipe pressure during a no-load operation, the atmospheric pressure is considered as a constant. When b=1 and po=constant, then the computer stages 47 and 48 can be dispensed with. During this procedure, of course, a certain degree of error is introduced in the computation of the suction pipe pressure.

As mentioned before, the characteristic line generator 46 in FIG. 3 serves for the correlation of the weight rate of air flow at a given position of the throttle valve. In this characteristic line, it is, of course, possible to include also the influence of the cross-section control member 19 in by-pass channel 18 on the throttle valve 14 (see FIG. 1).

In computing different operational parameters for an IC engine, the determination of atmospheric pressure is of particular importance inasmuch as the atmospheric pressure is a measure for air density and individual characteristic magnitudes are dependent on this parameter and must be derived from the latter.

Flow charts illustrated in FIGS. 5 through 7 represent models of analog computing arrangements to reproduce or simulate the atmospheric pressure on the basis of the aforementioned mathematical formula 2 reading as follows:

$$\dot{m}zu(t) = f(\alpha_{DK}) - po \cdot c \cdot \sqrt{\left(\frac{ps}{po}\right)^{\frac{2}{X}} - \left(\frac{ps}{po}\right)^{\frac{X+1}{X}}}$$

Referring to the arrangement for computing atmospheric pressure according to FIG. 5, position signal $\alpha_{DK}$ of throttle valve is applied to input terminal 45 of a function generator 46 whose output delivers an air mass signal $\dot{m}DK$ referred to at constant atmospheric pressure poRef. This output signal is applied to one input of a dividing stage 50. The other input of the dividing stage is connected to an input terminal 30 for a signal $\dot{m}zu$ corresponding to the measured air mass. The output signal of the divider 50 corresponds to the expression $$\dot{m}zu(t) = f(\alpha_{DK}) \cdot po \cdot c \cdot \sqrt{\left(\frac{ps}{po}\right)^{\frac{2}{X}} - \left(\frac{ps}{po}\right)^{\frac{X+1}{X}}}$$

Assuming that the value for f equals approximately 1 then the dividing stage 50 immediately delivers the signal po corresponding to the atmospheric pressure. This assumption however must be verified. For this purpose, the signal po·f together with the suction pipe pressure signal ps from input terminal 53 are applied to an additional dividing stage 54. The result of the dividing operation executed in the dividing stage 54 is applied to an interrogating stage 51. The interrogating stage compares the pressure ratio ps/(po·f) with a constant a amounting for example to 0.7 because for values of ps/po less than 0.7, according to characteristic line of FIG. 4, a value f equals approximately to 1. The output terminal 55 is connected to the output of the divider 50 via a switch 56 which is controlled by the output signal "nein" from the interrogating stage 51. This switching function is introduced into the computing process for the reason that according to the characteristic line of FIG. 4, for values of ps/po larger than 0.7, the aforementioned assumption f equals approximately 1 is no longer valid and consequently in this case the computation result would be erroneous.

While in the example of FIG. 5, the signal ps indicative of the suction pipe pressure is still necessary, the computing arrangement of FIG. 5 makes it possible to determine the atmospheric pressure only on basis of the following auxiliary parameters: position of throttle valve, supplied air mass and rotary speed. In this computing arrangement the suction pipe pressure is simulated by way of a model by an arrangement corresponding to that of FIG. 2. Accordingly, the computing arrangement of FIG. 6 is a combination of arrangements of FIGS. 2 and 5 and corresponding circuit stages are indicated by like reference characters.

FIG. 7 illustrates a modification of FIG. 6. In FIG. 7, control signal for adjusting the position of cross-section regulating member 19 (FIG. 1) serves as a basis for computation of the pressure signal. To obtain the most exact computation result of the desired pressure valve, there is also considered in the computation the leakage air occurring during the closed position of the throttle valve. For this purpose, during the idling speed and at a suction pipe pressure below a certain threshold value psw (for example 350 millibars) supplied air mass related to a reference pressure value poRef and an air mass fed in through the by-pass 18 and related also to a reference pressure poRef are used for determining the value of leakage air m'DK divided by the reference pressure poRef and the resultant value is stored.

In FIG. 7, an input terminal 60 for signal pulses indicative of the actuation of the cross-section control member 19, is connected to the input of a characteristic line generator 61 whose output delivers a signal $\dot{m}$Byp/poRef indicating the air mass flowing through the by-pass channel 18 (FIG. 1) and related to a reference pressure poRef. The latter signal is applied to a minus input of a subtraction stage 62. The plus input of the subtracting stage is held via signal $\dot{m}$zu/poRef denoting the entire air mass related to the reference pressure. At the output of the subtraction stage 62 a signal is generated which indicates leakage air related to a reference pressure poRef (flowing through the throttle valve). This output signal is applied via a switch 63 which during the idling operation is closed, to a memory 64 where the value of the leakage air at a closed throttle valve 14 is stored. The output signal mDK/poRef from the memory is applied to one input of a summer 65 whose other input is connected to the output of generator 61 so that the output from the memory may be added to the output signal $\dot{m}$Byp/poRef. The output from summer 65 is applied to a dividing stage 50 described previously in the example of FIG. 5 and the rest of the arrangement corresponds to that of FIG. 6.

The interrelation of the adjusted duty cycle of the control signal for the cross-section regulating member 19 and of the supplied air mass related to reference pressure poRef, is stored in the characteristic line generator 61. If the ratio psm/(po·f) is larger than a, than even the arrangement of FIG. 7 cannot determine the atmospheric pressure. If, however this ratio is less than a then the output value from the dividing stage 50 corresponds to that of the atmospheric pressure.

The computation of the atmospheric pressure in the latter case is particularly advantageous inasmuch, instead of measuring the air mass $\dot{m}$zu, the air mass $\dot{m}$zu is measured. Contemporary flap pipe air amount meters will use during their measuring operation an air density error, namely their result $\dot{m}$zu equals $\dot{m}$mzu. By determining the atmospheric pressure by computation, air density sensors in fuel air mixture producing and controlling systems can be dispensed with without making the so-called altitude error perceptible. To this end in the arrangements of FIGS. 5 through 7, a signal $\dot{m}$mzu is fed through the input terminal 30 and the dividing stage 50 performs the following computing operation:

$$\left(\frac{\dot{m}mzu}{\dot{m}DK}\right)^2 \cdot poRef = po \cdot f$$

From the above relationship, it wil be seen that the squared expression is illustrative of the difference between computing the air mass and the air amount.

It will be understood that each of the elements described above, or two or more together, may also find a useful application in other types of arrangements differing from the types descrived above.

While the invention has been illustrated and described as embodied in an electronic control system using analog computation stages, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electronic system for controlling or regulating idling speed of an internal combustion engine, in dependency on auxiliary parameters including rotary speed, weight rate of air flow in suction pipe, throttle valve position, suction pipe pressure, atmospheric pressure or temperature, comprising means for sensing a part of said auxiliary parameters inclusive of the weight rate of air flow in suction pipe and the throttle valve position, means for determining atmospheric pressure from the sensed part of auxiliary parameters, means for controlling said idling speed, means for computing control parameters from the interrelation of said idling speed and said auxiliary parameters and for applying the control parameters to said controlling means, the sensed part of auxiliary parameters including the suction pipe pressure, and the atmospheric pressure being determined under consideration of leakage air of the throttle valve in its closed condition, the leakage air being measured during idling speed of the engine and the resulting signal being stored in a memory for further processing.

2. An electronic system as defined in claim 1, wherein said computing means determines suction pipe pressure from at least the weight rate of air flow and from the rotary speed of the engine.

3. An electronic system as defined in claim 2, wherein the weight rate of air flow is determined from the throttle valve position.

4. An electronic system as defined in claim 2, wherein the weight rate of air flow is determined from the cross-section of a channel bypassing the throttle valve.

5. An electronic system as defined in claim 1, wherein the suction pipe pressure is determined from the other auxiliary parameters.

6. An electronic system as defined in claim 1, wherein the air mass supplied to the engine is computed from the suction pipe pressure and from the atmospheric pressure.

7. An electronic system as defined in claim 1, wherein the amount of supplied air is computed from the suction pipe pressure and from the atmospheric pressure.

8. A device as defined in claim 1, wherein the control signals are computed from the following mathematical relationships:

suction pipe pressure ps $$ps = \frac{R \cdot (273^\circ + \theta_{LS})}{V_s} \int (\dot{m}zu(t) - \dot{m}ab(t))\, dt$$

supplied air mass $\dot{m}$zu $$\dot{m}zu(t) = f(\alpha_{DK}) \cdot po \cdot c \cdot \sqrt{\left(\frac{ps}{po}\right)^{\frac{2}{X}} - \left(\frac{ps}{po}\right)^{\frac{X+1}{X}}}$$

discharged air mass $\dot{m}$ ab $$\dot{m}ab(t) = \frac{VH \cdot n \cdot \lambda_L}{2R\,(273^\circ + \theta_{LS})} \cdot \frac{X(\epsilon - 1) + 1}{X(\epsilon - 1)} \left( ps \cdot \frac{pa}{X(\epsilon - 1) + 1} \right)$$

wherein the auxiliary parameters are as follows: c is a constant, R is a gas constant, $\theta_{LS}$ is temperature of sucked in air, $V_s$ is suction pipe volume, mzu is supplied air mass, mab is discharged air mass, X is adiabatic exponent, po is atmospheric pressure, pa is exhaust gas pressure, VH is stroke volume of the engine, $\epsilon$ is compression ratio of the engine $\lambda_L$ is degree of admission of the motor, $\alpha_{DK}$ is opening angle of the throttle valve, n is rotary speed of the engine.

* * * * *